United States Patent [19]

Gray et al.

[11] Patent Number: 5,010,710

[45] Date of Patent: Apr. 30, 1991

[54] GROUND ROD DRIVER

[75] Inventors: Daniel W. Gray, Maple City, Mich.; Thomas E. Jewett, Littleton, Colo.

[73] Assignee: Foresight Industries, Inc., Commerce City, Colo.

[21] Appl. No.: 509,133

[22] Filed: Apr. 16, 1990

[51] Int. Cl.[5] ..... E04B 1/00

[52] U.S. Cl. ..... 52/742; 29/275; 254/29 R; 173/90

[58] Field of Search ..... 52/742, 749; 173/90; 29/254, 275; 254/29 R; 175/19, 122, 135

[56] References Cited

U.S. PATENT DOCUMENTS

| | | | |
|---|---|---|---|
| 3,961,671 | 6/1976 | Adams et al. | 52/742 X |
| 3,961,672 | 6/1976 | Welsch et al. | 254/29 R X |
| 4,044,513 | 8/1977 | Deike . | |
| 4,595,062 | 6/1986 | Boyadjieff et al. | 254/29 R X |
| 4,708,528 | 11/1987 | Rippe | 254/29 R X |
| 4,746,096 | 5/1988 | Donnell et al. | 254/29 R |
| 4,790,392 | 12/1988 | Clements | 173/90 X |
| 4,802,317 | 2/1989 | Chandler . | |
| 4,882,891 | 11/1989 | Sero et al. | 52/742 |

*Primary Examiner*—David A. Scherbel
*Assistant Examiner*—Creighton Smith
*Attorney, Agent, or Firm*—Hill, Van Santen, Steadman & Simpson

[57] ABSTRACT

Rods, tubes, posts, and the like rod structures are driven into the ground by a device which is successively clamped to selected intermediate portions of the lengths of these rods to avoid heretofore involved awkwardness, instability, and unsafe driving conditions encountered when the top ends of long rods are engaged to force the rods into the ground. The device is easily and quickly clamped to the rod at a level close to the ground to be impacted by a driving tool such as a jackhammer at a convenient reachable height. When the device is driven to ground level, it is easily released from the rod and raised to a starting level and then reclamped for the next driving increment. The successive raising and driving steps are repeated until the rod is driven to a desired depth in the ground. When the top end of the rod approaches ground level, the device can be mounted over this end and impacted to drive the rod further into the ground. A driving shank is slidably retained in a socket of the device spaced laterally from the clamp rod and inclined toward the rod so that the device will deliver type impact blow substantially along the axis of the rod to minimize bending. The device is especially useful for rods which drive ground anchors into the ground.

22 Claims, 2 Drawing Sheets

FIG. 4

FIG. 5
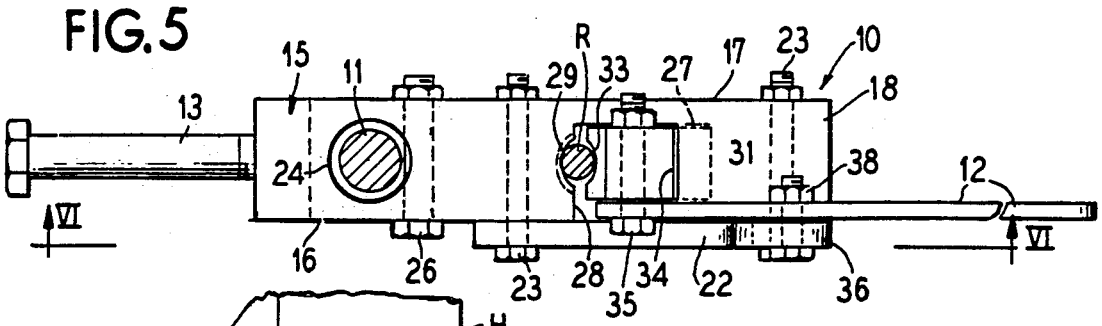
FIG. 6
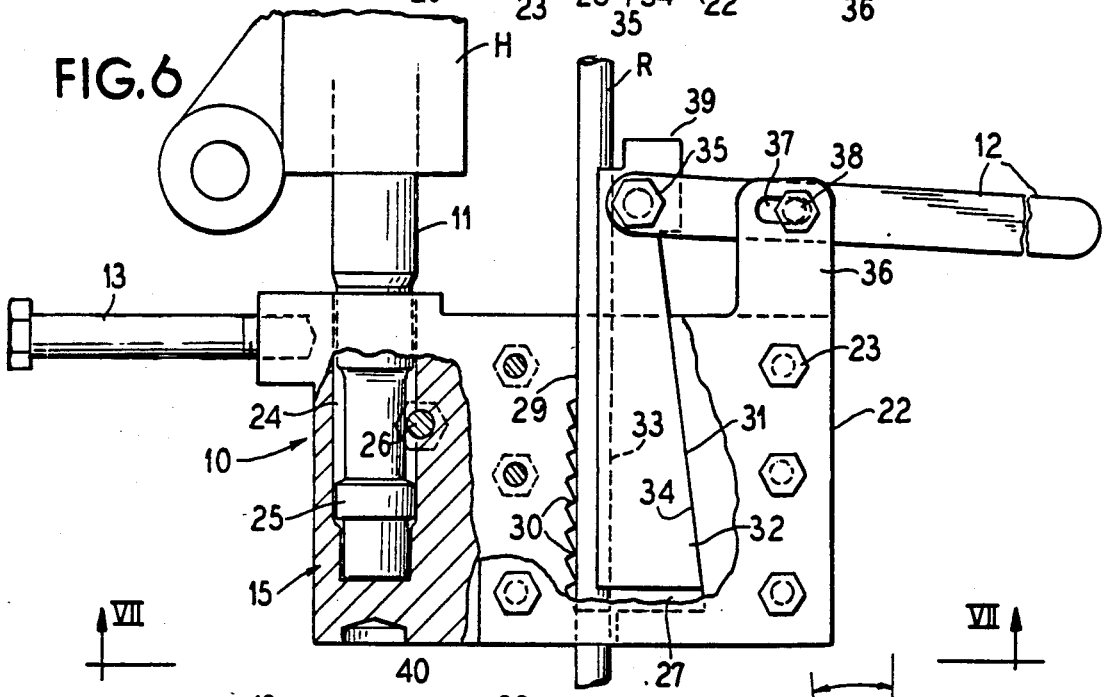
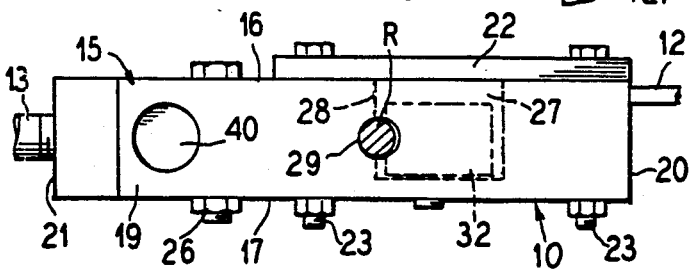
FIG. 7
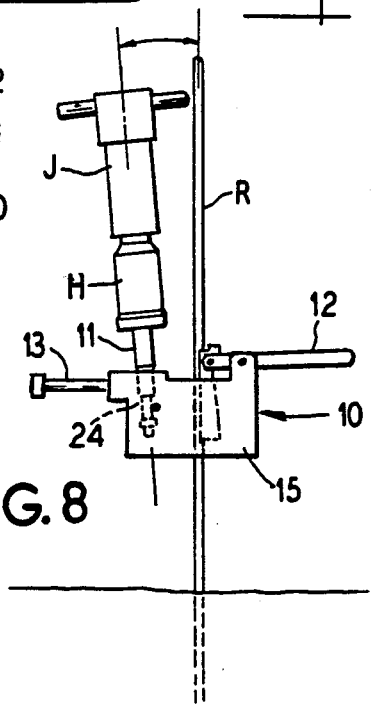
FIG. 8

GROUND ROD DRIVER

BACKGROUND OF THE INVENTION

Field of the Invention

This invention relates to the art of driving structures such as rods, tubes, posts and the like into the ground and especially deals with a ground rod driver successively clamped along the length of the rod transferring impact blows from a driving tool to the rod axis to minimize bending stress of the rod and to provide convenient, safe operating heights for the driving tool.

Heretofore structures to be driven into the ground such as rods, posts, tubes and the like were impacted at their top ends by manual or power driven hammers. This created an awkward, difficult, and unsafe operating position, especially with rods of more than a few feet in length. When the top end of the rod was above the shoulder height of the hammer operator, it was necessary for the operator to stand on a platform to have the impact blows delivered to the top end of the rod. Even in operations where the driving tool was suspended from an overhead crane or the like, the impact blows delivered to the top end of the rod would tend to bend the rod between the ground and the impacted top end. This type of known driving operation is especially troublesome with long drive rods that force ground anchors into the ground to depths sufficient to fix the anchor in the ground.

It would therefore be a definite improvement in this art to provide a device for driving rods and the like into the ground which avoids all of the deficiencies and problems of the heretofore required procedure of impacting the end of the rod with a manual or power operated hammer.

It would especially be an improvement in this art to force rods and the like into the ground from a level close to the ground through the media of a driver clamped to an intermediate portion of the rod, above but close to the ground, driven to ground level, raised on the rod to a starting level and reclamped to the rod for successively forcing increments of the rod length into the ground without subjecting the rod to damaging bending stresses.

An important feature of this invention is to provide a rod driving system which pushes rods into the ground by a force applied close to the ground along the axis of the rod.

As used herein and the claims, the term "rod" includes structures driven into the ground such as rods, tubes, posts, bars, stakes, and the like.

SUMMARY OF THE INVENTION

This invention now provides a ground rod driver which transmits driving forces to intermediate portions of a rod along the rod axis to push successive increments of the rod into the ground and thereby avoid heretofore encountered difficulties inherent with the driving of the rod from its top end.

According to this invention a body member has a rod receiving passageway therethrough and a clamp acting in this passageway to selectively grip a rod extending through the passageway. The body has an open top, closed bottom socket laterally spaced from the passageway freely receiving the bottom end portion of a drive shank of a manual or power hammer such as a jackhammer. The end of the shank impacts the closed bottom of the socket to transfer the impact blows through the body to the rod clamped in the passageway of the body. Since the socket and rod passageway are laterally spaced the socket is inclined toward the rod so that the impact blows will be delivered substantially axially of the rod.

A shank retainer selectively projects into the socket to retain the end of the shank in the socket while accommodating free sliding of the shank in the socket.

The body carries a clamp actuating lever or handle especially useful for positioning the clamp to grip the rod and for releasing the clamp from the rod in the passageway. Once the clamp engages the rod in the passageway, the driving force applied to the body will wedge the clamp against the rod to lock the body to the rod.

A handle on the body provides for the easy lifting of the body along the length of the rod.

In operation, the body is clamped to an intermediate portion of the rod at a level close to but above the ground. An upright hammer, such as a power driven jackhammer receives the drive shank above the block and the position of the block on the rod is selected so that the top handles or grips of the jackhammer are not appreciably above the shoulders of the operator. Thus the operator may stand on the ground, conveniently grasp the jackhammer and drive the rod into the ground until the body meets the ground or is within an inch or two above the ground. Then the rod clamp is released, the block is raised on the rod to a starting level in the order of two to three feet above the ground, the rod is reclamped to the body, and the jackhammer is again operated to drive the next increment of length of the rod into the ground. The operation is continued until the rod has reached its desired depth in the ground.

The bottom of the body is also provided with a rod receiving recess under the socket so that when the top of the rod approaches ground level, the body can be placed over this top and the jackhammer actuated to drive the top end of the rod to ground level.

The invention will be further understood by the illustrations of the attached drawings of a best mode embodiment of the invention and the following descriptions of the drawings.

ON THE DRAWINGS

FIG. 5 is a plan view, with parts in section taken generally along the line V—V of FIG. 4.

FIG. 6 is a side elevational view along the line VI—VI of FIG. 5 with parts broken away in vertical sections to show underlying parts.

FIG. 7 is a bottom plan view along the line VII—VII of FIG. 6.

FIG. 8 is a schematic side view showing the angle of inclination of the socket to deliver the impact force substantially along the axis of the rod.

AS SHOWN ON THE DRAWINGS

Figure 1:
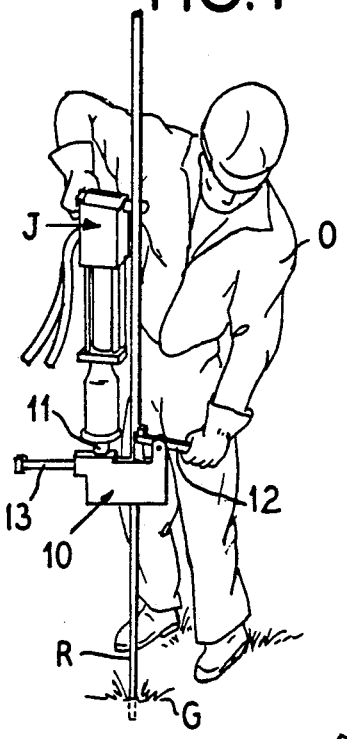
FIGS. 1-3 are schematic illustrations of the steps of operating the ground rod driver of this invention.
Figure 2:
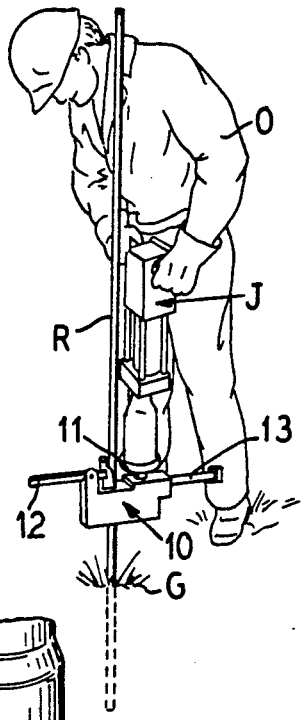
Figure 3:
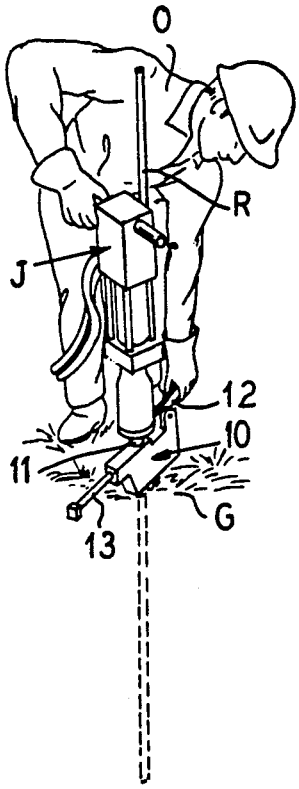

In FIGS. 1-3, the ground rod driver 10 is illustrated on a vertical rod R being driven into the ground G from hammer blows of a jackhammer J held upright by an operator O over a driving shank 11 projecting upward from the driver.

In FIG. 1, the left hand of the operator O is illustrated as pushing down on a clamp lever 12 to lock the driver 10 to an intermediate portion of the rod R at a height above the ground where the right hand of the operator can grasp the handle of the jackhammer J engaging the driving shank 11. From this comfortable, initial driving position the operator O, as illustrated in FIG. 2, can push down on the handles of the jackhammer J and operate the hammer for driving the driver 10 toward the ground G to force that portion of rod R between the ground and driver into the ground.

When the driver 10 reaches ground level or slightly above ground level, as illustrated in FIG. 3, the operator pulls up the lever 12 to release the clamp from the driver 10 and lift the jackhammer and the driver 10 suspended therefrom to a level above the ground and back to the comfortable driving position illustrated in FIG. 1. The three steps are repeated until a desired rod depth is reached. It will be especially noted that in all of the steps, the operator O has his feet firmly on the ground and at no time is he forced into an awkward unstable or unsafe position.

When the lever 12 is lifted as illustrated in FIG. 3 and the clamp is released, the operator may conveniently grasp a handle 13 on the driver to raise the driver 10 to the position of FIG. 1.

Figure 4:
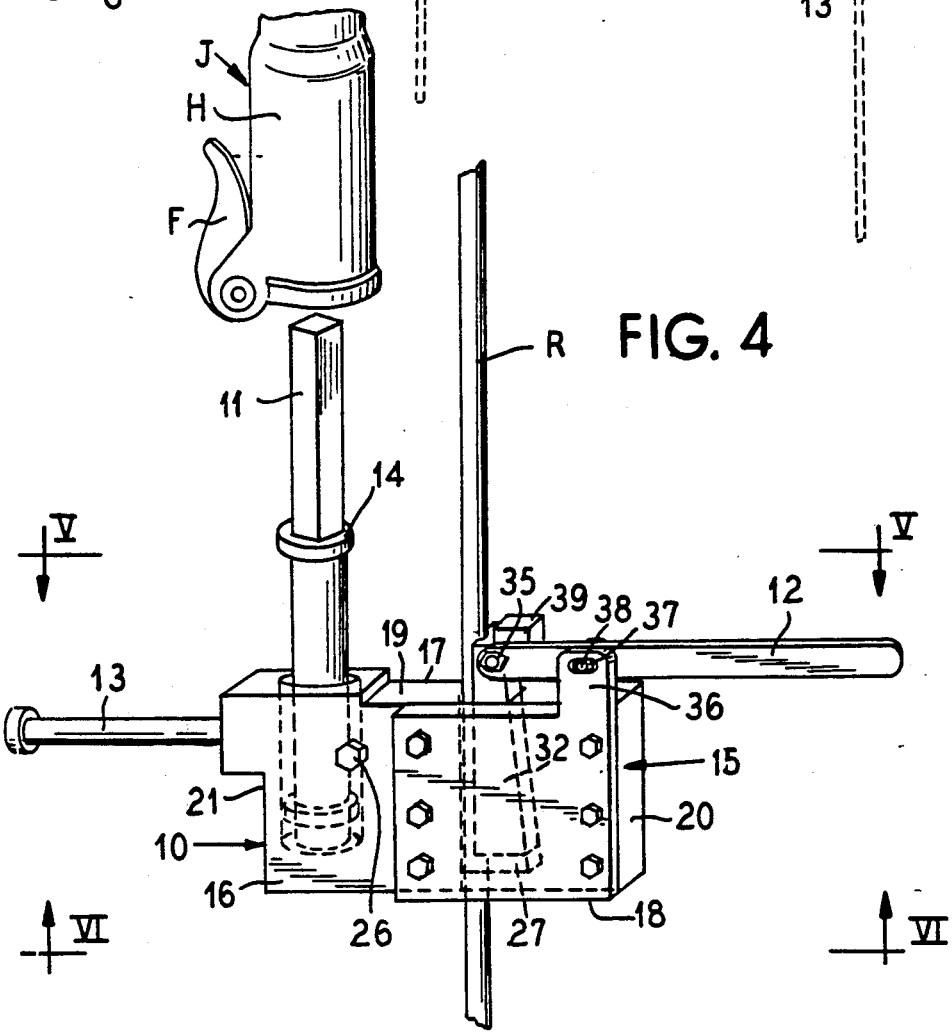
FIG. 4 is a perspective view of the ground rod driver illustrating the manner in which a jackhammer is applied to the drive shank.

As illustrated in FIG. 4 the jackhammer J has an open bottom cup housing H receiving the top end of the driving shank 11 and a flange 14 on an intermediate portion of the shank fits into the bottom end of the cup housing H to be selectively engaged by a locking finger F of the hammer. The conventional driving piston (not shown) of the jackhammer impacts the top end of the shank to deliver the hammer blows to the driver 10.

As illustrated in FIGS. 4–8, the ground rod driver 10 has a rigid, preferably metal body 15, preferably in the shape of a rectangular block with flat front and rear faces 16 and 17, flat top and bottom walls 18 and 19 and flat ends 20 and 21. A cover 22 is bolted to a portion of the front face 16 by fasteners 23. The uncovered portion of the body has an open top, closed bottom socket 24 freely receiving the bottom end portion of the drive shank 11. The shank 11 for a jackhammer is usually hexagonal, but the socket may be cylindrical to accommodate different sizes of shanks. The bottom end of this drive shank is enlarged to provide an abutment 25 for engagement with a removable cross bolt 26 exposed along the socket to clear the shank above the abutment. This cross bolt however does not interfere with the free sliding of the shank in the socket 24 to deliver its hammer blow to the body 15 at the bottom of the socket.

The body 15 has a slot-like vertical recess 27 in the front face 16 thereof open to the top end 18 but closed to the back face 17 and bottom 19 and covered at the front face by the removable cover 22. This recess 27 has a wall 28 adjacent the socket 24 which is arcuately recessed along its length at 29 and this arcuate portion 29 has transverse teeth 30 spaced along its length to grip a rod R extending through the recess. The arcuate portion 29 has a large radius to accommodate rods of different diameters and the teeth 30 will bite into rods of different sizes.

The recess 27 has an opposite wall 31 which diverges from top to bottom to provide a tapered surface for a jaw 32 of the clamping mechanism. This jaw 32 is a bar-like member with a recessed front face 33 opposing the arcuate recess 29 of the wall 28 to engage the opposite side of that portion of the rod extending through the body 15 and bottomed in the recess 29. The back face 34 of the jaw 32 is tapered to slide on the tapered wall 31 of the recess.

The jaw 32 protects above the top 18 of the housing block 15 and is pinned to the inner end of the lever 12 by a bolt 35.

The top of the cover 22 has an upstanding lug 36 with a horizontal slot 37 above the top 18 of the block receiving a pivot hinge 38 for the lever 12.

The arrangement is such that when the outer end of the lever is pushed down, the lever will swing about the pivot 38 to raise the hinge pin 35 and pull the jaw 32 upwardly. The tapered face 34 of the jaw will slide on the complimentary face 31 of the recess 27 forcing the jaw toward the wall 28 and thereby decreasing the gap between the recessed portions 33 and 29 and of course, thereby gripping the rod into fixed anchored relation with the body 15 of the driver. The slot 37 will accommodate movement of the lever so as not to interfere with the gripping action of the jaw. As the device 10 is hammered downward, the jaw gripping the rod will be wedged toward the teeth 30 to prevent any slippage between the device and rod. Pulling the lever upward pushes the jaw downward releasing it from the rod.

The jaw 32 has a top end surface 39 above the lever 12 that is adapted to be hit by a hammer or the like to release the jaw from the rod in the event the lifting of the lever to force the jaw downwardly into the recess is not sufficient to unclamp the jaw from the rod.

As illustrated in FIG. 8, the socket 24 in the body 15 is tilted toward the upright rod R on which the body is clamped so that the driving shank 11 will deliver its blows to the body 15 with a force vector on a line intersection the rod substantially along its axis at ground level thereby decreasing tending stress of the rod due to the lateral offset of the shank from the rod axis. Any force vector tending to bend the rod because of the lateral distance between the clamped rod and the socket will be delivered at or below ground level where the rod is surrounded by a sheath of earth holding the rod against bending. The angle of inclination of the socket can vary depending upon the lateral offset between the socket and clamped rod and the selected starting height of the driver from the ground. When the selected height is around two to three feet and the offset is about 8 inches an angle of inclination of around 8 degrees between the axis of the shank and the rod axis is sufficient.

The shank is allowed to rebound freely in the socket for a distance between the abutment 25 and the cross bolt 15 to minimize friction and heat.

The cross bolt 15 can be positioned at a selected level in the socket to accommodate a desired rebound for a selected jackhammer J.

The bottom 19 of the housing block 15 has a recess 40 under the socket 245 to receive the top end of a rod R when it is adjacent ground level so that the driver 10 can be used to force the top of the rod to ground level.

From the above detailed descriptions, it will be understood to those skilled in this art that the driver 10 of this invention is easily clamped on and released from a rod to be driven into the ground and is positioned on the rod at a convenient level for operating a driving tool such as a jackhammer. The rod may remain in the ground or used to drive a ground anchor to a desired depth and then pulled out of the anchor and ground.

While the driving operations have been illustrated as applied to vertical rods, it will be appreciated that the driver of this invention is useful for driving rods at an angle into the ground.

We claim as our invention:

1. A device for driving rods and the like into the ground which comprises a body member having a rod receiving passage therethrough, a clamp in said passage to releasably lock an intermediate portion of a rod in said passage to the body member, an open top, closed bottom socket in the body member spaced laterally from the passage, and a drive shank slidable in said socket adapted to strike the bottom of the socket and projecting above the body member and adapted to be impacted by a driving tool for transferring driving force through the body member to the rod clamped in the passage.

2. The device of claim 1, wherein the socket is inclined toward the passage to minimize bending stresses imparted to a rod clamped to the body member.

3. The device of claim 1, wherein the clamp is a wedge slidable in a recess in the body member.

4. The device of claim 1, including a lever on the body member actuating the clamp.

5. The device of claim 1, wherein the body member has a bottom wall with a recess therein adapted to receive the top end of a rod driven in the ground.

6. The device of claim 1, including a lever pivoted to the top of the body member for actuating the clamp and providing a handle projecting from an end of the body member.

7. The device of claim 6, including a second handle projecting from the opposite end of the body member.

8. The device of claim 2, wherein the socket is inclined so that the drive shank delivers impact blows with a force vector on a line delivered to a rod entering the ground at ground level.

9. A device for transferring force from a driving tool to a rod being driven into the ground from a level close to the ground and spaced from the ends of the rod without subjecting the rod to appreciable bending stress which comprises a body member having a rod receiving passage therethrough, a wedge member slidable in said body member facing said passage, a lever pivoted on the body member pinned to said wedge member for sliding the wedge member along the passage to selectively clamp and release a rod extending through the passage, an open top, closed bottom socket in said body member spaced laterally from said passage and inclined downwardly toward the passage, and a shank rod having a bottom end slidable in the socket to impact against the bottom end of the socket and a top end projecting above the body member adapted to receive a driving tool whereby driving force from the driving tool is delivered to the body member with a force vector minimizing bending stress on a rod clamped to the body member.

10. The device of claim 9, wherein the angle of inclination of the socket relative to a rod clamped in the passage is around eight degrees.

11. The device of claim 9, wherein the wedge member projects above the body member and has an end face adapted to be struck by a hammer to release a rod clamped in the passage.

12. The device of claim 9, including an abutment on the bottom portion of the shank rod and a removable shank pin extending across the socket to engage the abutment and retain the shank rod in the socket while allowing the shank rod to slide in the socket.

13. A ground rod driver which comprises a generally rectangular metal block having front and back faces, elongated top and bottom sides and opposite ends, said front face having an upright slot communicating with the top, said slot having a first side wall with an arcuate groove along the length thereof, said slot having a second side wall opposite the first wall diverging from the top of the block, an upstanding wedge member slidable in said slot having a first face opposite the first side wall of the slot with an arcuate groove along the length thereof opposing the arcuate groove of the first side wall of the slot, said wedge member having a second wall opposite the first wall inclined to mate with the diverging wall of the slot, a lever pivoted on the top of the block pinned to the top of the wedge member to pull the wedge member upwardly into clamping engagement with a rod extending between the grooved faces of the first side wall of the slot and the first wall of the wedge member for clamping a rod therebetween and for pushing the wedge member toward the bottom of the slot to release it from a gripped rod, a plate secured to the front face of the block overlying the wedge member and covering the slot, a socket in the top of the block spaced laterally from said slot adapted to receive a driving shank actuated by a driving tool to impact the block for transmitting driving force from the tool through the block to a rod clamped between the wedge member and first side wall of the slot.

14. A ground rod driver which comprises a rigid block, a clamp carried by said block for locking the block to an intermediate portion of a rod to be driven in the ground, a socket in said block spaced laterally from a rod clamped to the block, and a jackhammer actuated shank having an end slidable in the socket to impact against the block and deliver a driving force to the rod clamped to the block.

15. The device of claim 14, wherein the clamp includes a wedge block slidable in the block and means for sliding the wedge block into and out of clamped engagement with the rod.

16. The device of claim 15, wherein the wedge block has an arcuate face for embracing the rod.

17. The method of driving a rod into the ground which comprises clamping a block to an intermediate portion of the rod at a level close to the ground impacting the block to drive that portion of the rod between the block and ground into the ground, unclamping the block from the rod, raising the block above the ground, reclamping the raised block to the rod and repeating the impacting, unclamping, raising and clamping steps until the rod is driven to a desired depth in the ground.

18. The method of claim 17, wherein the direction of impacting is at an angle to the axis of the rod to deliver a main force vector along the axis of the rod to minimize bending of the rod.

19. The method of claim 17, wherein the impacting comprises repeated blows from a hammer.

20. The method of claim 19, wherein the blows are delivered by a jackhammer shank rod to a socket in the block spaced laterally from the rod and inclined downwardly toward the rod.

21. A ground rod driver having a block adapted to be clamped to an intermediate portion of a rod at a level close to the ground and impacted to drive that portion of the rod between the block and ground into the ground, to then be unclamped from the rod, raised above the ground, and reclamped to the rod and to have the impacting, unclamping, raising the clamping steps repeated until the rod is driven to a desired depth into the ground which comprises a rigid block, a clamp locking the block to an intermediate portion of a rod to be driven into the ground, said block having means spaced laterally from a rod clamped to the block for receiving impact blows, and a jackhammer actuated shank member for delivering impact blows to the block causing the block to force a rod clamped thereto into the ground.

22. The driver of claim 21, including an open top socket in said block receiving a portion of said jackhammer actuated shank in slidable relation therewith.

* * * * *